US005682435A

United States Patent [19]

De Wit et al.

[11] Patent Number: 5,682,435

[45] Date of Patent: Oct. 28, 1997

[54] APPARATUS COMPRISING A BAFFLE AND A LOUDSPEAKER, AND LOUDSPEAKER FOR USE IN THE APPARATUS

[75] Inventors: Marcus G. M. De Wit, Eindhoven; Michiel A. A. Schallig, Drachten, both of Netherlands

[73] Assignee: U.S. Philips Corporation, New York, N.Y.

[21] Appl. No.: 551,219

[22] Filed: Oct. 31, 1995

[30] Foreign Application Priority Data

Nov. 4, 1994 [EP] European Pat. Off. ..... 94203225

[51] Int. Cl.[6] ..... H04R 25/00

[52] U.S. Cl. ..... 381/188

[58] Field of Search ..... 381/193, 199, 381/188, 205; 181/171, 172

[56] References Cited

U.S. PATENT DOCUMENTS

| | | | |
|---|---|---|---|
| 3,905,448 | 9/1975 | Kawakami et al. | 181/172 |
| 4,158,756 | 6/1979 | Keezer | 381/193 |
| 4,492,826 | 1/1985 | Chiu | 181/171 |
| 5,115,474 | 5/1992 | Tsuchiya et al. | 181/172 |
| 5,293,009 | 3/1994 | Fleischer | 181/171 |

FOREIGN PATENT DOCUMENTS

| | | |
|---|---|---|
| 0516471A1 | 12/1992 | European Pat. Off. . |
| 0 516 471 | 2/1992 | United Kingdom . |

*Primary Examiner*—Curtis Kuntz
*Assistant Examiner*—Rexford N. Barnie
*Attorney, Agent, or Firm*—Debra K. Stephens

[57] ABSTRACT

An apparatus includes a baffle (41) and a loudspeaker (1). The stiffness of the loudspeaker chassis is dimensioned so as to reduce transmission of vibrations from the loudspeaker to the baffle.

11 Claims, 3 Drawing Sheets

APPARATUS COMPRISING A BAFFLE AND A LOUDSPEAKER, AND LOUDSPEAKER FOR USE IN THE APPARATUS

FIELD OF THE INVENTION

The invention relates to an apparatus comprising a baffle and a loudspeaker provided with a mounting element for mounting the loudspeaker on the baffle, a diaphragm having a first mass $M_1$, which is movable in a direction of excursion and is connected to the mounting element by a first suspension having a first stiffness $K_1$ in the direction of excursion, and a magnet system having a second mass $M_2$, which is connected to the mounting element by a second suspension having a second stiffness $K_2$ in the direction of excursion. The stiffness of a suspension is to be understood to mean the ratio between the force exerted on a suspension point and the excursion of the suspension point as a result of this force.

The invention also relates to a loudspeaker for use in the apparatus defined in the opening paragraph.

RELATED ART

Such a loudspeaker is known from EP-A-0,516,471. The known loudspeaker comprises a chassis carrying a magnet system and a diaphragm, by means of which chassis the loudspeaker can be mounted in an apparatus. A coil connected to the diaphragm cooperates with the magnet system to drive the diaphragm. When the diaphragm is driven the magnet system is subjected to reaction forces. By means of the chassis these forces are transmitted to the apparatus in which the loudspeaker is mounted. In order to minimise this transmission of forces the magnet system is connected to the chassis via a rubber suspension. By giving this rubber suspension a very low stiffness the movements of the magnet system are isolated from the chassis. A drawback of the known loudspeaker is that the isolation is only effective for higher frequencies. Another drawback of the known loudspeaker is that vibrations of the diaphragm are transmitted to the apparatus via the suspension of the diaphragm, which may still give rise to undesired vibrations in the apparatus. Besides, the rubber suspension requires additional parts and additional assembly operations during the manufacture of the loudspeaker.

SUMMARY OF THE INVENTION

It is an object of the invention to improve an apparatus of the type defined in the opening paragraph so as reduce the transmission of vibrations from the loudspeaker to the baffle of the apparatus.

To this end, the apparatus in accordance with the invention has, as a character $$0.5\frac{K_1}{M_1} < \frac{K_2}{M_2} < 2\frac{K_1}{M_1}.$$

The stiffnesses $K_1$ and $K_2$ are generally expressed in N/m and the masses $M_1$ and $M_2$ in kg. The invention is based on the recognition of the fact that when the loudspeaker is driven both the diaphragm and the magnet system are set into vibration and that both parts transmit these vibrations as dynamic forces to the mounting element of the loudspeaker. By means of a balancing process in accordance with the above relationship it can be achieved that the dynamic forces exerted on the mounting element by the magnet system and the dynamic forces exerted on the mounting element by the diaphragm compensate for each other. If the proposed measure is applied this compensation will be effective over a large frequency range. It has been found that this measure leads to loudspeakers which can be implemented very well in practice. Owing to this recognition it has proved that a substantial reduction of the transmission of vibrations from the loudspeaker to the baffle of an apparatus can be achieved even in the case of very large tolerances in the manufacture of the loudspeaker.

An embodiment of the apparatus in accordance with the invention is characterised in that $$0.8\frac{K_1}{M_1} < \frac{K_2}{M_2} < 1.2\frac{K_1}{M_1}.$$

This measure enables the transmission of vibrations from the loudspeaker to the apparatus in the centre of the frequency range of interest to be reduced by approximately 20 dB in comparison with an apparatus with a loudspeaker without any measures. For audio and television equipment this frequency range of interest ranges from 0 to 600 Hz because in this range resonances of the housings of such equipment may occur. These resonances are excited by the loudspeaker and may therefore give rise to annoying noises. Moreover, the shadow mask in a picture tube of a television apparatus may be set into vibration as a result of the transmission of vibrations of the loudspeaker to the shadow mask. These vibrations of the shadow mask result in a deterioration of the picture quality of the television apparatus. As a result of the proposed measure, the vibrations in the apparatus are reduced to an acceptable level without any special steps for the purpose of vibration damping being required in the apparatus.

An embodiment of the apparatus in accordance with the invention is characterised in that the loudspeaker comprises a chassis carrying the magnet system and the mounting element, the chassis has a such a shape that it is compliant in the direction of excursion, and the stiffness $K_2$ of the second suspension is mainly determined by the compliance of the chassis. It has been found that the required stiffness for the suspension of the magnet system can be obtained by giving the chassis a suitable shape. This shape can be obtained by a mere adaptation of the die by means of which the chassis is manufactured.

An embodiment of the apparatus in accordance with the invention is characterised in that the compliance of the chassis is obtained by means of a meander shape. By means of this measure it is achieved that the stiffness in the direction of excursion of the diaphragm has the required value while the stiffness of the chassis in other directions can remain high. A high stiffness in the other directions is desirable in order to keep a coil, which is secured to the diaphragm and situated in a gap of the magnet system, correctly centred in this gap.

An embodiment of the apparatus in accordance with the invention is characterised in that the chassis is made of a plastics. This plastics may be, for example, polyvinyl chloride or polystyrene, if desired reinforced with fibres such as carbon fibres or glass fibres. An advantage of this embodiment is that intricate shapes such a meander shape can be moulded at low cost by means of an injection-moulding die.

Embodiments of the loudspeaker in accordance with the invention are constructed as described above.

The invention will now be described in more detail, by way of example, with reference to the drawings, in which

DESCRIPTION OF THE PREFERRED EMBODIMENTS

It is to be noted that the embodiments are shown diagrammatically and the Figures are shown to an arbitrary and not always the same scale.

Figure 1:
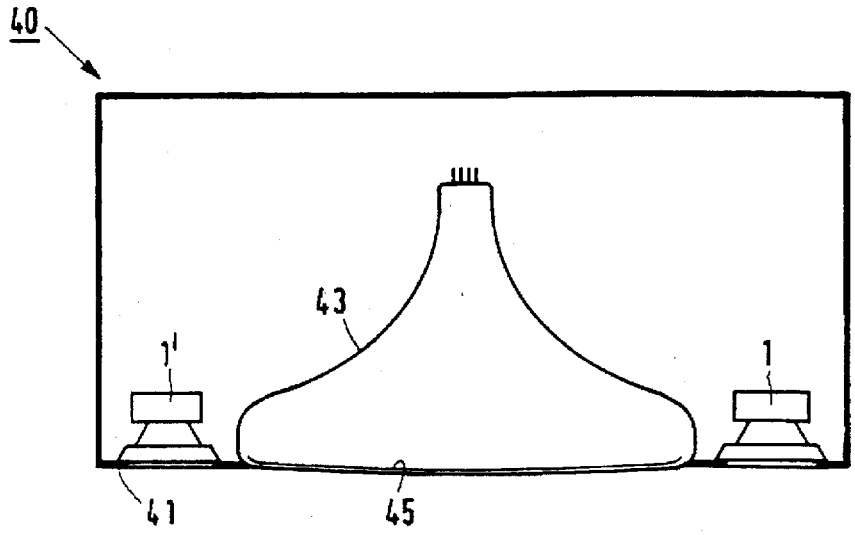
FIG. 1 shows an embodiment of an apparatus in accordance with the invention.

FIG. 1 shows an apparatus in accordance with the invention, in the present case a television apparatus 40 accommodating loudspeakers 1. The loudspeakers 1 are mounted on a baffle 41. The television apparatus 40 further comprises a picture tube 43, in which a shadow mask 45 is mounted. In modem television sets much attention is paid to the sound quality produced by these sets. Moreover, the output power to be delivered by the loudspeakers 1 is constantly raised. Since the loudspeakers 1 vibrate with the frequency of the sound to be produced these vibrations are transmitted to the baffle 41 of the apparatus 40 and, via this baffle 41, they are further transmitted to other parts of the apparatus such as for example the shadow mask 45. If the amplitude of the vibrations in the shadow mask 45 exceed a given value this will clearly manifest itself as a deterioration of the picture quality produced by the picture tube 43. In addition, vibrations of the baffle 41 lead to undesirable noises.

Figure 2:
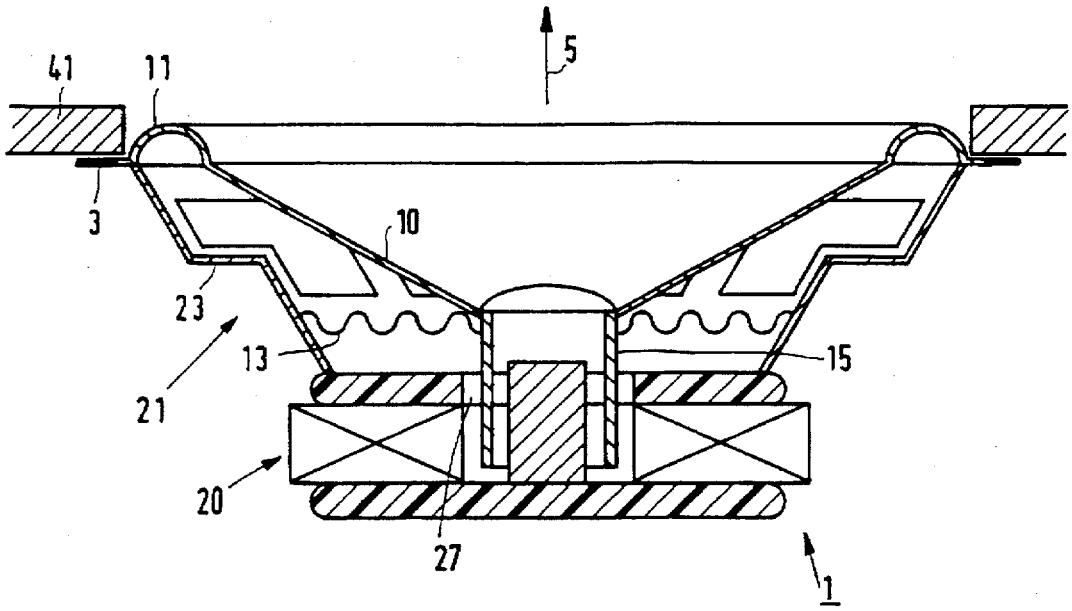
FIG. 2 is a sectional view of a first embodiment of the loudspeaker in accordance with the invention for use in an apparatus in accordance with the invention.

FIG. 2 shows a detail of an apparatus 40 with the baffle 41 and the loudspeaker 1. The loudspeaker 1 has a mounting element 3 for mounting the loudspeaker 1 onto the baffle 41. The loudspeaker 1 further comprises a diaphragm 10, which is movable in a direction of excursion 5 in order to radiate sound. The diaphragm 10 is connected to the mounting element 3 by means of a first suspension, in the present case a compliant surround 11 having a first stiffness $K_1$ in the direction of excursion 5. In addition, the loudspeaker 1 comprises a magnet system 20 having a second mass $M_2$ and connected to the mounting element 3 by a second suspension, in the present case formed by a chassis 21. The chassis 21 has such a shape that it is compliant in the direction of excursion 5. Thus, the magnet system 20 is suspended to mounting element 3 via the chassis 21 having a second stiffness $K_2$. The construction of the chassis 21 is such that the ratio between the second stiffness $K_2$ and the mass $M_2$ of the magnet system and the ratio between the first stiffness $K_1$ of the first suspension and the mass $M_1$ of the diaphragm are substantially equal to one another. The chassis 21 includes a frame 23.

Figure 3:
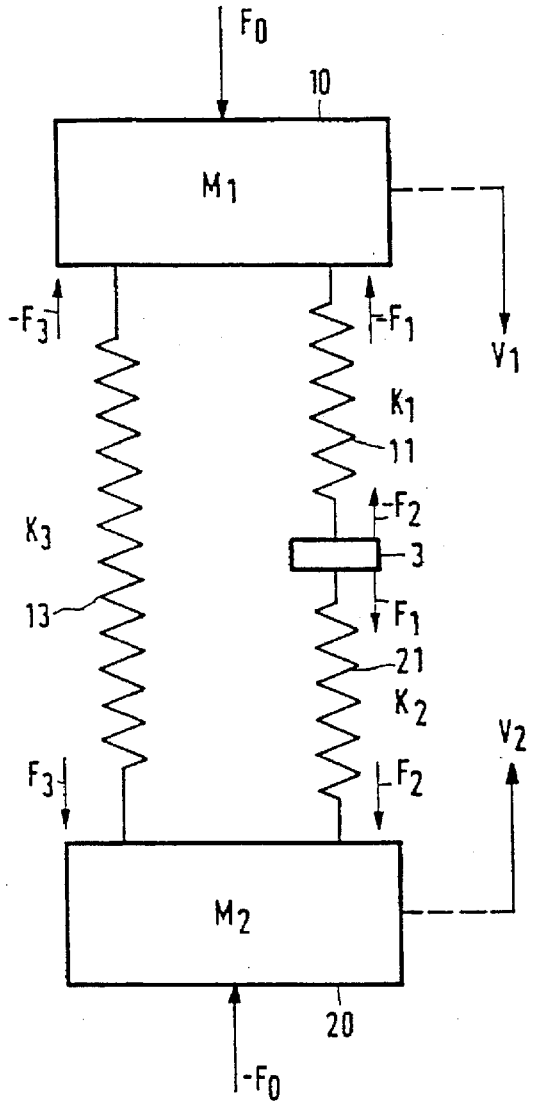
FIG. 3 is a diagrammatic representation of the relevant masses and stiffnesses in the loudspeaker in accordance with the invention for the frequency range of 0– 600 Hz.

FIG. 3 shows diagrammatically the forces exerted by the various pans on one another. By energising the coil 15 shown in FIG. 2 a dynamic force $F_0$ is exerted on the diaphragm 10, shown as a block marked $M_1$ in FIG. 3, and an equal but opposite force $-F_0$ is exerted on the magnet system 20, shown as a block marked $M_2$ in FIG. 3. The diaphragm 10 is connected to the mounting element 3 by means of a suspension 11 having a first stiffness $K_1$. A force $F_0$ exerted on the diaphragm 10 results in the mounting element 3 being subjected to a force $F_1$. The magnet system 20 is connected to the mounting element 3 by means of a suspension 21 having a second stiffness $K_2$. A force $-F_0$ on the magnet system 10 results in a force $-F_2$ on the mounting element 3. Moreover, the diaphragm 10 and the magnet system 20 are connected by a third suspension 13 having a third stiffness $K_3$ and exerting a force $-F_3$ on the cone and a force $F_3$ on the magnet system. This third suspension corresponds to a centring diaphragm 13 in FIG. 2. Such a centring diaphragm 13 serves to centre the coil 27 of the magnet system 20. To allow this function to be performed correctly this centring diaphragm 13 is generally arranged near the magnet system 30. In the case that the centring diaphragm 13 is connected to the mounting element 3 and the diaphragm 10 the stiffness $K_1$ should first be calculated from the sum of the stiffness of the surround 11 and the centring diaphragm 13.

The invention is based on the recognition of the fact that the transmission of vibrations from the loudspeaker to the baffle 41 can be prevented if the sum of the dynamic forces $F_1$ and $-F_2$ exerted on the mounting element is zero. This requirement can be met by selecting the parameters $K_1$, $K_2$, $M_1$ and $M_2$ in a given proportion. How this proportion should be may be understood as follows. The sum of the forces on the mass $M_1$ results, via the admittance $Y_{M1}$ of the mass $M_1$, in a velocity $V_1$ which depends upon the frequency f of the impressed force $F_0$. This velocity $V_1$ results in a force $F_1$ on the mounting element 3 via the admittance $Y_{K1}$ of the first stiffness. Expressed as a formula this is as follows:

$$V_1 = (F_0 - F_3 - F_1)Y_{M1}$$

$$F_1 = \frac{V_1}{Y_{K1}}$$

Likewise $$V_2 = (F_0 - F_3 - F_2)Y_{M2}$$

$$F_2 = \frac{V_2}{Y_{K2}}$$

Since the situation is described in which no vibrations are transmitted to the mounting element the mounting element is assumed to be stationary. The desired proportion can be derived by assuming that the force $F_1$and the force $F_2$ are equal to one another. This yields the following formula:

$$F_1 = F_2 \Rightarrow \left\{ \begin{array}{l} \frac{V_1}{Y_{M1}} = \frac{V_2}{Y_{M2}} \\ \frac{V_1}{Y_{K1}} = \frac{V_2}{Y_{K2}} \end{array} \right\} \quad \frac{Y_{M1}}{Y_{M2}} = \frac{Y_{K1}}{Y_{K2}} \tag{1}$$

The admittance of a mass M is given by $$Y_M = \frac{1}{j\omega M}.$$

The admittance of a stiffness K is given by $$Y_K = \frac{j\omega}{K},$$

where $\omega=2\pi f$. Together with equation (1) this yields $$\frac{K_1}{M_1}=\frac{K_2}{M_2}. \quad (2)$$

When the requirement (2) is met the sum of the forces on the mounting element 3 is equal to 0 regardless of the frequency of the impressed force $F_0$. This precludes the transmission of vibrations from the loudspeaker 1 to the baffle 41 so that no undesirable noises or disturbances of the picture quality will arise.

Figure 4:
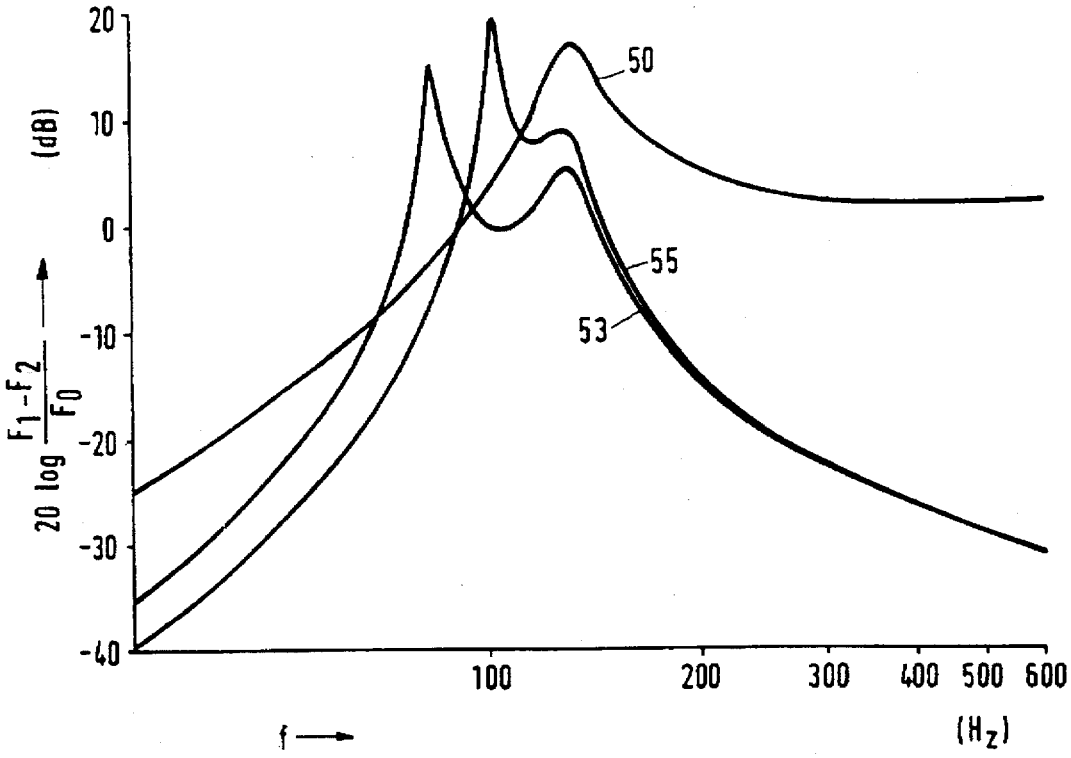
FIG. 4 shows the transmission of vibrations from the loudspeaker in accordance with the invention to the baffle as a function of the frequency for a number of different suspensions of the magnet system to the mounting element.

FIG. 4 shows to a logarithmic scale the transmission of the impressed force $F_0$ to the baffle 41 as function of the frequency f for a number of systems (the transmission is the ratio between the sum $F_1$–$F_2$ of the forces exerted on the mounting element 3 and the impressed force $F_0$). The curve 50 represents the transmission of a known system for a customary stiffness $K_2$ of the second suspension. The curves 53 and 55 represent this transmission for systems with a second stiffness $K_2$ which deviates minus and plus 20% from the optimum stiffness $K_2$, the optimum stiffness $K_2$ being given by the above equation (2). A deviation from the optimum stiffness results in a peak in the transmissions 53 and 55, so that the transmission of vibrations from the loudspeaker 1 to the baffle 41 is even amplified in certain frequency bands. However, for the major pan of the relevant frequency range the transmission of vibrations is reduced substantially owing to the measure in accordance with the invention. In this case the suspension 11 of the diaphragm 10 exhibits a damping, resulting in a finite quality factor of a first resonant system formed by the diaphragm 10 and the suspension 11. In the present case a second resonant system comprising the magnet system 20 and the second suspension 21 also has a finite quality factor because the second suspension also exhibits damping. It has been found that even a deviation from the optimum value for $K_2$ by a factor of two still yields a substantial reduction of the transmission of vibrations from the loudspeaker 1 to the baffle 41.

Figure 5:
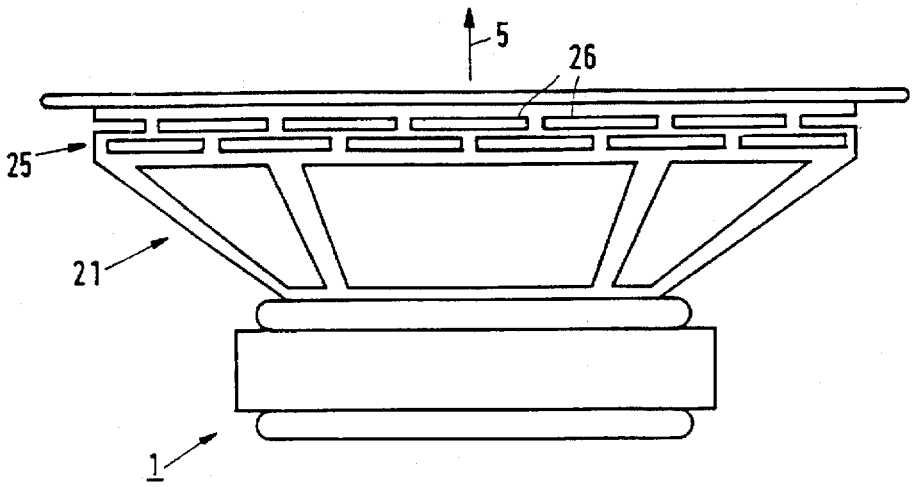
FIG. 5 shows an second embodiment of the loudspeaker in accordance with the invention for use in an apparatus in accordance with the invention.

FIG. 5 shows a further embodiment of a loudspeaker for use in the apparatus in accordance with the invention. In this embodiment the compliance of the chassis 21 is obtained by means of a meander shape 25. This meander shape is obtained by providing the chassis 21 with circumferential rows of slots 26, which slots extend perpendicularly to the direction of excursion 5 of the diaphragm 10, the rows being offset from one another. Such a meander shape 25 is particularly suitable because it enables the required stiffness in the direction of excursion 5 to be obtained, whereas a very high stiffness can be achieved in directions perpendicular thereto. This is desired because the coil 15 is disposed in a narrow gap 27 of the magnet system 20 (see FIG. 2). A low stiffness of the chassis 21 in directions perpendicular to the direction of excursion 5 could result in the coil 15 colliding with the magnet system 20, thereby impairing a correct operation of the loudspeaker 1.

The chassis 21 is preferably made of a plastics. This plastics may be, for example, polyvinyl chloride or polystyrene reinforced, if required, with fibres such as carbon fibres or glass fibres.

Figure 6:
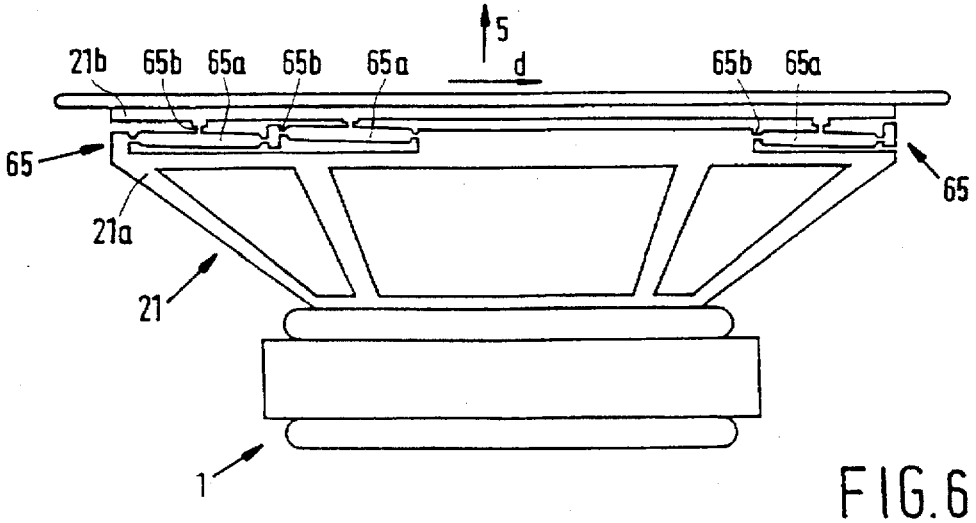
FIG. 6 shows a third embodiment of the loudspeaker in accordance with the invention.

In the loudspeaker in accordance with the invention shown in FIG. 6 the chassis 21 comprises a plurality of, in the present example three, integral hinge elements 65, which are uniformly spaced in a circumferential direction of the loudspeaker. (FIG. 6 shows only one and one half hinge element.) The hinge elements 65 each have two rod-shaped hinge bodies **65*a* and integral hinges 65*b*, which connect the hinge bodies 65*a* to one another and, at one end, to a chassis portion 21*a* and, at the other end, to a chassis portion 21*b*, in a manner as shown in the drawing. In the present example, the chassis 21 and the hinge elements 65 are made of a plastics and may be constructed as a single injection-moulded product. The present construction is very suitable to achieve a low stiffness in the main direction of the loudspeaker, i.e. the direction of excursion 5, and to oppose translations in the other directions and rotations about axes in all directions. The present hinge elements 65** can be used in general to interconnect two members with desired stiffnesses.

It is to be noted that the invention is not limited to the embodiments shown herein. Several other embodiments are possible without departing from the scope of the invention. For example, the diaphragm 10 and the magnet system 20 may be connected to one another or to the mounting element 3 by a plurality of suspensions. However, by means of the inventive concept it is always simple to determine the requirements to be met in such a situation in order to reduce the transmission of vibrations from the loudspeaker to a baffle 41 in the apparatus 40.

We claim:

1. An apparatus (40) comprising a baffle (41) and a loudspeaker (1) provided with:

a mounting element (3) for mounting the loudspeaker on the baffle;

a diaphragm (10) having a first mass $M_1$, which is movable in a direction of excursion (5) and is connected to the mounting element by a first suspension (11) having a first stiffness $K_1$ in the direction of excursion; and a magnet system (20) having a second mass $M_2$, which is connected to the mounting element by a second suspension (21) having a second stiffness $K_2$ in the direction of excursion, characterized in that $$0.5\frac{K_1}{M_1}<\frac{K_2}{M_2}<2\frac{K_1}{M_1}.$$

2. An apparatus (40) as claimed in claim 1, characterised in that $$0.8\frac{K_1}{M_1}<\frac{K_2}{M_2}<1.2\frac{K_1}{M_1}.$$

3. An apparatus (40) as claimed in claim 1, wherein:

the loudspeaker (1) comprises a chassis (21) carrying the magnet system (20) and the mounting element (3);

the chassis has a shape that is compliant in the direction of excursion (5); and the stiffness $K_2$ of the second suspension (21) is mainly determined by the compliance of the chassis.

4. An apparatus as claimed in claim 3, wherein the compliance of the chassis (21) is obtained by means of a meander shape (25).

5. An apparatus (40) as claimed in claim 3, wherein the chassis (21) is made of a plastic.

6. A loudspeaker (1) comprising:

a diaphragm (10) having a first mass $M_1$, which is movable in a direction of excursion (5) and is connected to the mounting element by a first suspension (11) having a first stiffness $K_1$ in the direction of excursion; and a magnet system (20) having a second mass $M_2$, which is connected to the mounting element by a second suspension (21) having a second stiffness $K_2$ in the direction of excursion, such that $$0.5\frac{K_1}{M_1} < \frac{K_2}{M_2} < 2\frac{K_1}{M_1}.$$

7. An apparatus (40) as claimed in claim 2, wherein:

the loudspeaker (1) comprises a chassis (21) carrying the magnet system (20) and the mounting element (3);

the chassis has a shape that is compliant in the direction of excursion (5); and the stiffness $K_2$ of the second suspension (21) is mainly determined by the compliance of the chassis.

8. An apparatus (40) as claimed in claim 4, wherein the chassis (21) is made of a plastic.

9. An apparatus (40) as claimed in claim 7, wherein the chassis (21) is made of a plastic.

10. A loudspeaker (1) comprising:

a diaphragm (10) having a first mass $M_1$, which is movable in a direction of excursion (5) and is connected to a mounting element by a first suspension (11) having a first stiffness $K_1$ in the direction of excursion; and a magnet system (20) having a second mass $M_2$, which is connected to the mounting element by a second suspension (21) having a second stiffness $K_2$ in the direction of excursion, such that $$0.8\frac{K_1}{M_1} < \frac{K_2}{M_2} < 1.2\frac{K_1}{M_1}.$$

11. A loudspeaker (1) comprising:

a diaphragm (10) having a first mass $M_1$, which is movable in a direction of excursion (5) and is connected to a mounting element by a first suspension (11) having a first stiffness $K_1$ in the direction of excursion;

a magnet system (20) having a second mass $M_2$, which is connected to the mounting element by a second suspension (21) having a second stiffness $K_2$ in the direction of excursion, such that $$0.5\frac{K_1}{M_1} < \frac{K_2}{M_2} < 2\frac{K_1}{M_1}; \text{ and}$$

a chassis (21) carrying the magnet system (20) and the mounting element (3), the chassis having a shape that is compliant in the direction of excursion (5), the stiffness $K_2$ of the second suspension (21) being mainly determined by the compliance of the chassis.

* * * * *